US011572089B2

(12) United States Patent
Stokes

(10) Patent No.: US 11,572,089 B2
(45) Date of Patent: Feb. 7, 2023

(54) ENHANCED SAFETY PROXIMITY (ESP) ALERTER

(71) Applicant: CSX Transportation, Inc., Jacksonville, FL (US)

(72) Inventor: Kevin Stokes, Jacksonville, FL (US)

(73) Assignee: CSX TRANSPORTATION, INC., Jacksonville, FL (US)

( * ) Notice: Subject to any disclaimer, the term of this patent is extended or adjusted under 35 U.S.C. 154(b) by 456 days.

(21) Appl. No.: 16/777,614

(22) Filed: Jan. 30, 2020

(65) Prior Publication Data

US 2020/0255042 A1 Aug. 13, 2020

Related U.S. Application Data

(60) Provisional application No. 62/802,570, filed on Feb. 7, 2019.

(51) Int. Cl.

| | |
|---|---|
| ***B61L 1/02*** | (2006.01) |
| ***B61L 23/34*** | (2006.01) |
| ***B61L 23/06*** | (2006.01) |
| ***G08B 7/06*** | (2006.01) |
| ***G08B 21/02*** | (2006.01) |
| ***B61L 27/40*** | (2022.01) |
| ***B61L 27/70*** | (2022.01) |

(52) U.S. Cl.

CPC ..... *B61L 23/34* (2013.01); *B61L 23/06* (2013.01); *B61L 27/40* (2022.01); *B61L 27/70* (2022.01); *G08B 7/06* (2013.01); *G08B 21/02* (2013.01); *B61L 2205/04* (2013.01)

(58) Field of Classification Search

CPC ..... B61L 23/34; B61L 23/06; B61L 27/40; B61L 27/70; B61L 2205/04; G08B 7/06; G08B 21/02

USPC ..... 246/124; 340/992, 988, 994, 539.11

See application file for complete search history.

(56) References Cited

U.S. PATENT DOCUMENTS

| | | | | |
|---|---|---|---|---|
| 7,624,952 | B1 * | 12/2009 | Bartek | B61L 23/06 246/477 |
| 2014/0104081 | A1 * | 4/2014 | Cross | B61L 25/025 340/989 |
| 2016/0096537 | A1 * | 4/2016 | Bartek | B61L 15/0027 246/124 |
| 2016/0152254 | A1 * | 6/2016 | Dreasher | B61L 15/0027 701/19 |
| 2017/0015336 | A1 * | 1/2017 | Bartek | B61L 23/06 |
| 2018/0162428 | A1 * | 6/2018 | Fortin | B61L 23/06 |
| 2018/0301012 | A1 * | 10/2018 | Carlson | B61L 25/025 |

* cited by examiner

*Primary Examiner* — Anh V La

(74) *Attorney, Agent, or Firm* — McGuireWoods LLP

(57) ABSTRACT

A system and method for providing a proximity alert information form a locomotive directly to a device usable by wayside personnel or vehicles thereby alerting the personnel of an approaching locomotive. The proximity alert is facilitated by current PTC and ITCM messaging infrastructure, or is retrofittable to non-PTC equipped locomotives.

18 Claims, 4 Drawing Sheets

ENHANCED SAFETY PROXIMITY (ESP) ALERTER

CROSS REFERENCE TO RELATED APPLICATIONS

This is an application of claims benefit and priority to U.S. Provisional Patent Application No. 62/802,570, filed Feb. 7, 2019, entitled "ENHANCED SAFETY PROXIMITY (ESP) ALERTER" the disclosure of which is hereby incorporated herein by reference in its entirety.

FIELD OF THE DISCLOSURE

The present disclosure relates generally to proximity alert of a train approaching a geographic location, and more particularly to a system and method related to safety proximity alerts to devices used by individuals for alerting of a train approaching a geographic location, among other features.

BACKGROUND OF THE DISCLOSURE

Management of train rail networks and maintenance of rail plant, including track, crossings, rail side equipment of many kinds, typically involves dispatching personnel to geographic locations along the rail lines. Once personnel are dispatched to a particular geographic location proximate a train track, such as for maintenance or repair, then awareness by the dispatched personnel of train traffic into or through that particular geographic location is necessary to assure safety to the personnel and train operations.

Currently, this is often done generally using a dispatch system involving radio communications with the dispatched personnel and one or more trains to coordinate train traffic and the maintenance at a particular location.

However, the current systems and techniques do not provide a technique for the train to directly alert the personnel when it approaches the particular geographic location where the personnel are working. Improving the ability of a train to broadcast its location as it travels with adequate time for personnel to react in a suitable manner would increase safety overall.

SUMMARY OF THE DISCLOSURE

According to an aspect of the disclosure, a alerting system for use with locomotives is provided comprising a messaging device positioned on at least one locomotive to initiate broadcast of a Positive Train Control (PTC) message including locomotive GPS location, locomotive speed and locomotive identifier (ID) from the at least one locomotive to a surrounding geographic area of the at least one locomotive as the at least one locomotive is in motion, and an alerter device comprising a receiving radio that receives the PTC message at a location, such as, e.g., at a wayside location, and determines and displays on a display a distance that the at least one locomotive is to the wayside location, and provides an audible alert when the locomotive is within a specified time of that location. The PTC message may comprise an Interoperability Train Control Messaging (ITCM) that includes the locomotive GPS location, the locomotive speed and the locomotive ID, and timestamp of the ITCM message. The Interoperability Train Control Messaging (ITCM) may be sent at a predetermined interval on the PTC common channel so as to minimize message collisions on the common channel. The alerter device may receive the PTC message and performs one or more of the following: a) calculates a distance to the at least one locomotive from the alerter device; b) calculates a speed of the at least one locomotive from prior locations in prior received PTC messages; c) compares the calculated speed to a reported speed of the at least one locomotive for error detection; d) calculates a time to a location of the alerter device based on the speed of the at least one locomotive; e) drives an alert to a user of the alerter device when the locomotive is at a predetermined amount of time from a current location of the locomotive to the location of the alerter device; and f) displays a plurality of locomotive IDs for a closest predetermined number of locomotives, including current locomotive distance for each of the plurality of locomotives on a display. The alerter device may be a receive-only device that does not transmit PTC signals. The alerter device may be a receive-only device and is pre-tuned to a fixed frequency. The alerter device may increase a level of the audible alert as the at least one locomotive approaches the alerter device. The alerter device after receiving an initial ITCM communication from the at least one locomotive, may initiate the audible alert after a predetermined amount of time passes without another ITCM message from the at least one locomotive. The alerter device may remove the at least one locomotive ID from the alerter display after multiple consecutive locomotive beacons are received showing the locomotive moving further way. The broadcast of the Positive Train Control (PTC) message may be sent directly to the alerter device using a frequency in the 220 MHz band, or a frequency employed by PTC messaging.

In one aspect, a method for providing an alerting system for use with locomotives, comprises positioning a messaging device on at least one locomotive to initiate broadcast of a Positive Train Control (PTC) message including locomotive GPS location, locomotive speed and locomotive ID from the at least one locomotive to a surrounding geographic area of the at least one locomotive as the at least one locomotive is in motion, and receiving at an alerter device that comprises a receiving radio that receives the PTC message at a wayside rail location and determines and displays on a display a distance that the at least one locomotive is to the wayside rail location, and provides an audible alert. The PTC message may comprise an Interoperability Train Control Messaging (ITCM) that may include the locomotive GPS location, the locomotive speed and the locomotive ID, and timestamp of the ITCM message. The Interoperability Train Control Messaging (ITCM) may be sent at a predetermined interval on the PTC common channel thereby minimize message collisions on the common channel. The alerter device may receive the PTC message and performs one or more of the following: a) calculates a distance to the at least one locomotive from the alerter device; b) calculates a speed of the at least one locomotive from prior locations in prior received PTC messages; c) compares the calculated speed to a reported speed of the at least one locomotive for error detection; d) calculates a time to a location of the alerter device based on the speed of the at least one locomotive; e) drives an alert to a user of the alerter device when the locomotive is at a predetermined amount of time from a current location of the locomotive to the location of the alerter device; and f) displaying a plurality of locomotive IDs for a closest predetermined number of locomotives, including current locomotive distance for each of the plurality of locomotives on a display. The alerter device may be a receive-only device that does not transmit PTC signals. The alerter device may be a receive-only device and is pre-tuned to a fixed frequency.

The method may further comprise increasing a level of the audible alert as the at least one locomotive approaches closer to the alerter device. The method may include after receiving an initial ITCM communication from the at least one locomotive, initiating by the alerter device the audible alert after a predetermined amount of time passes without another ITCM message from the at least one locomotive. The alerter device may remove the at least one locomotive ID from the alerter display after multiple consecutive locomotive beacons are received showing the locomotive moving further way. The broadcast of the Positive Train Control (PTC) message may be sent directly to the alerter device using a frequency in the 220 MHz band, or other frequency employed by PTC messaging.

Additional features, advantages, and embodiments of the disclosure may be set forth or apparent from consideration of the detailed description and drawings. Moreover, it is to be understood that the foregoing summary of the disclosure and the following detailed description and drawings are exemplary and intended to provide further explanation without limiting the scope of the disclosure.

BRIEF DESCRIPTION OF THE DRAWINGS

The accompanying drawings, which are included to provide a further understanding of the disclosure, are incorporated in and constitute a part of this specification, illustrate embodiments of the disclosure and together with the detailed description serve to explain the principles of the disclosure. No attempt is made to show structural details of the disclosure in more detail than may be necessary for a fundamental understanding of the disclosure and the various ways in which it may be practiced. In the drawings.

Figure 1:
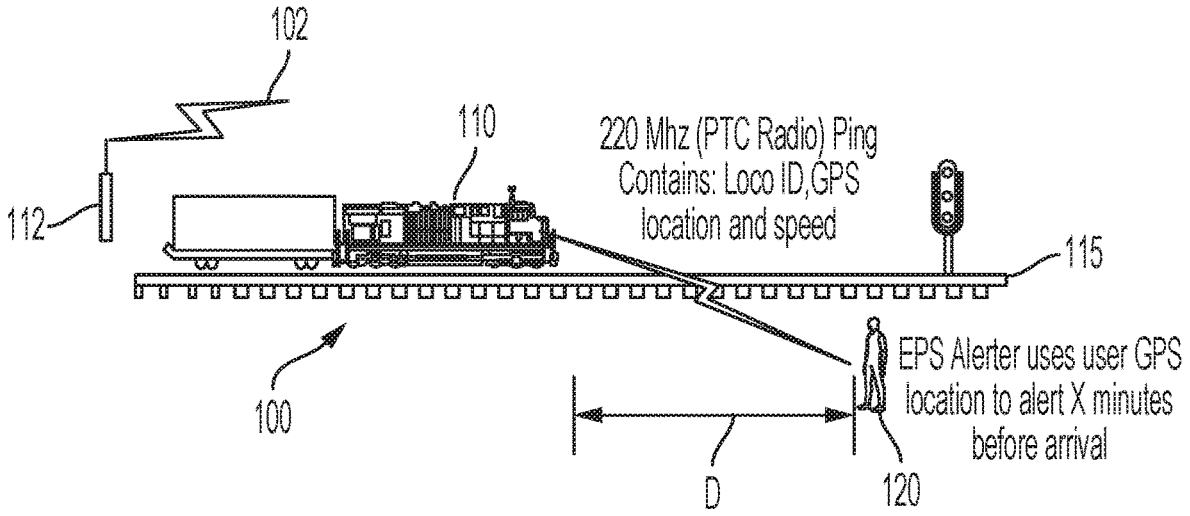
FIG. 1 is an example illustration of a train and personnel positioned along a rail line, according to the principles of the disclosure.

The present disclosure is further described in the detailed description that follows.

DETAILED DESCRIPTION OF THE DISCLOSURE

The disclosure and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments of the disclosure. The examples used herein are intended merely to facilitate an understanding of ways in which the disclosure may be practiced and to further enable those of skill in the art to practice the embodiments of the disclosure. Accordingly, the examples and embodiments herein should not be construed as limiting the scope of the disclosure. Moreover, it is noted that like reference numerals represent similar parts throughout the several views of the drawings.

A "communication link," as used in this disclosure, means a wireless medium that conveys data or information between at least two points. The wireless medium may include, for example, a radio frequency (RF) communication link, an Infrared (IR) communication link. The communication link may include, for example, a medium for providing Positive Train Control (PTC) communications.

Positive Train Control (PTC) is a national system designed to assist preventing train-to-train collisions, derailments caused by excessive speeds, unauthorized train movements in work zones, and the movement of trains through switches left in the wrong position. PTC networks enable real-time information sharing between trains, railroad companies, rail wayside devices, and "back office" applications, regarding train movement, speed restrictions, train position and speed, and the state of signal and switch devices. PTC currently is implemented using the 220 MHz band, typically from about 217 MHz to about 211 MHz. However, it is possible for creation of an equivalent system that uses other frequencies.

Interoperability Train Control Messaging (ITCM) is a messaging protocol for use to implement Positive Train Control (PTC) communication, specified by S-9280.0111 Edge Message Protocol Specification 2.2, promulgated by MeteorComm.

The terms "including," "comprising" and variations thereof, as used in this disclosure, mean "including, but not limited to," unless expressly specified otherwise.

The terms "a," "an," and "the," as used in this disclosure, means "one or more," unless expressly specified otherwise.

Devices that are in communication with each other need not be in continuous communication with each other, unless expressly specified otherwise. In addition, devices that are in communication with each other may communicate directly or indirectly through one or more intermediaries.

Although process steps, method steps, algorithms, or the like, may be described in a sequential order, such processes, methods and algorithms may be configured to work in alternate orders. In other words, any sequence or order of steps that may be described does not necessarily indicate a requirement that the steps be performed in that order. The steps of the processes, methods or algorithms described herein may be performed in any order practical. Further, some steps may be performed simultaneously.

When a single device or article is described herein, it will be readily apparent that more than one device or article may be used in place of a single device or article. Similarly, where more than one device or article is described herein, it will be readily apparent that a single device or article may be used in place of the more than one device or article. The functionality or the features of a device may be alternatively embodied by one or more other devices that are not explicitly described as having such functionality or features.

A "computer-readable medium," as used in this disclosure, means any medium that participates in providing data (for example, instructions) which may be read by a computer. Such a medium may take many forms, including non-volatile media, volatile media, and transmission media. Non-volatile media may include, for example, optical or magnetic disks and other persistent memory. Volatile media may include dynamic random access memory (DRAM).

Transmission media may include coaxial cables, copper wire and fiber optics, including the wires that comprise a system bus coupled to the processor. Common forms of computer-readable media include, for example, non-transitory mediums, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a computer. For example, sequences of instruction (i) may be delivered from a RAM to a processor, (ii) may be carried over a wireless transmission medium, and/or (iii) may be formatted according to numerous formats, standards or protocols, including, for example, WiFi, WiMAX, IEEE 802.11, DECT, 0G, 1G, 2G, 3G or 4G cellular standards, Bluetooth, or the like.

This disclosure is directed to providing an Enhanced Safety Proximity (ESP) alerting capability for improved rail-side safety awareness to personnel, among other features. The ESP is a low cost solution for extending safety alerts using the existing PTC system.

FIG. 1 is an example illustration of a train 110 and personnel 120 positioned along a rail line 115 in a general geographic area 100. Positioned along the rail line are one or more base stations 112 for providing PTC communications along a rail network. Typically, these base stations 112 are positioned at intervals for providing a continuous coverage of PTC communications to trains as the train 110 travels along a rail network. The base stations 112 may be positioned about every 20 miles, but distance may vary such as due to terrain topography. The base stations 112 may also provide a beacon signal 102. A base radio is not required for basic functions of ESP.

Personnel 120 may be, e.g., railroad workers performing duties such as maintenance of the rail line 115 or, alternatively, could be vehicles located along a rail line 115. As the distance "D", as shown in FIG. 1, from a train to the location of the personnel 120 decreases, then at some point in distance, when PTC radio signals transmitted by the train 110 are receivable at the location of personnel 120, the personnel is made aware of the approach of the train 110 via an alerter device 125, as described more fully below, so that safety measures can be taken, such as moving equipment from the rail area, leaving the rail area, or whatever might be appropriate for safety reasons.

Figure 2:
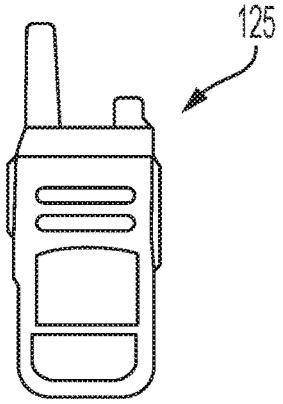
FIG. 2 is an illustration of an alerter device for use by rail-side personnel, constructed according to the principles of the disclosure.

FIG. 2 is an illustration of an alerter device 125, configured according to principles of the disclosure. Alerter device 125 is configured with a radio electronics and antenna. In particular, the alerter device 125 may be configured with a visual display, audible tone generation componentry and/or vibration componentry, a processor and software for controlling the functions of the alerter device 125, and electronics for receiving ITCM messages via radio RF, such as the 220 MHz signals of the PTC system (or other authorized signals). In embodiments, the alerter device 125 may be configured as a receive-only radio to minimize component costs. The alerter device 125 may be configured as a software defined radio (SDR). In other embodiments, the alerter device 125 might include transmit capability. The functionality of the alerter device can take on other form factors such as within a vehicle.

Figure 3:
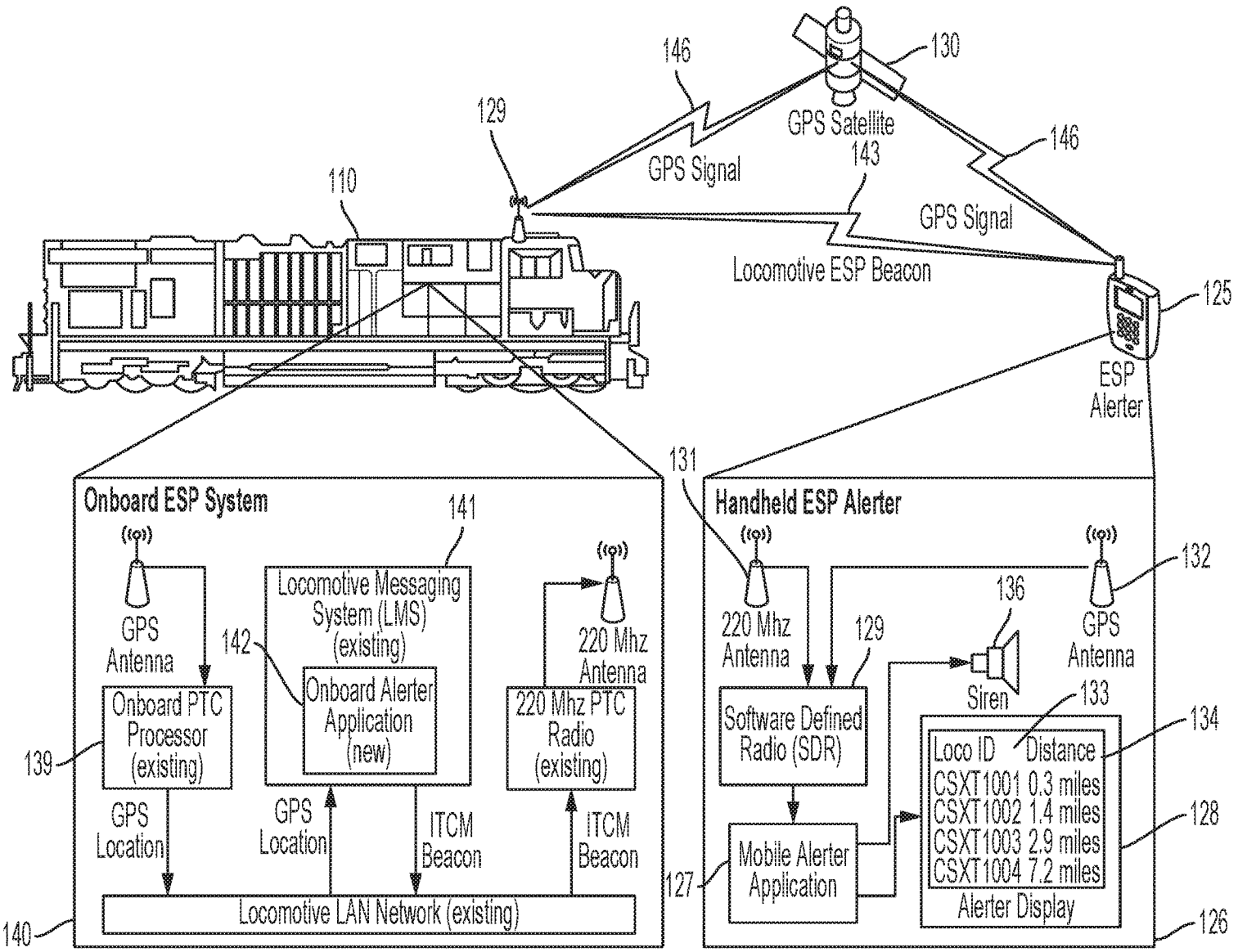
FIG. 3 is a generalized diagram of an example alerting system, according to the principles of the disclosure.

FIG. 3 is a generalized diagram of an example alerting system, according to the principles of the disclosure. The train 110 may be equipped with an onboard enhanced safety proximity (ESP) system 140. As shown in FIG. 3, the ESP system 140 may include an Onboard PTC possessor such as a train management computer (TMC) 139 such as, e.g., a Wabtec TMC, a global positioning system, (GPS) antenna for receiving GPS coordinates via GPS signal 146 of the train 110 from a satellite 130, locomotive messaging (LMS) system which comprises software 141, a 220 MHz band radio and antenna, all of the previous items typically being present in currently equipped PTC locomotives. The added novel component to PTC equipped locomotives being an onboard alerter application 142 which interacts and interfaces with the LMS 141 to provide a locomotive ESP beacon 143 to the alerter device 125.

The hand held alerter device 125, shown in exploded block diagram form, may include a mobile alerter application 127 embodied in a computer-readable medium, a software defined radio 129 for receiving PTC signals from train 110 via antenna 131 and/or receiving GPS signals from satellite 130 via antenna 132. The alerter device 125 further comprises a computer processor 126 to control functionality of the alerter device 125, an audible alert siren or speaker 136 to give audible warnings (and/or vibrator) of approaching trains and a display 128 for displaying warnings and information related to approaching trains received via PTC ITCM including one or more locomotive ID 133 and distance 134 of each train. Not shown is a power source that is typically a battery to power the various components of the alerter device 125, the status of the battery may be displayed on a display of the alerter.

This overall system functionality is rather straightforward, only relying on a one-way RF communication link directly between the locomotive 110 and the handheld alerter device 125. The simplicity of this arrangement provides a high reliability of the system and, second, to make the required equipment as cost effective as possible. The locomotive portion of the system may be built on existing equipment on a PTC-equipped locomotive. The only thing new that is added is an Onboard Alerter Application 142 that would create the required ITCM beacon message for broadcast to the alerter device 125. Such an ITCM beacon message from the locomotive includes:

Locomotive ID
Current locomotive GPS location
Current locomotive speed
Timestamp of the message The ITCM beacon message is broadcast over the locomotive's 220 MHz PTC radio (or other authorized frequency) using the common channel on a predetermined interval such as, e.g., a 17 second interval. This predetermined interval is meant to avoid collision with other PTC messages on a 4 second super frame, thereby leaving a possible collision possibility every 68 seconds, which is deemed acceptable. Other predetermined intervals may be possible, such as those deemed appropriate by the PTC-220 Spectrum Management Committee.

The alerter device 125 is a low cost device, about $250 or less, that may include existing Software Defined Radio (SDR) 129. The handheld alerter device 125 may include commonly available SDR software to capture the ITCM beacon messages from the locomotive 110, other messages may be discarded. In some embodiments, the SDR may be tuned permanently to a predefined frequency that is to be used for the ESP capability. The mobile alerter application 127 in conjunction with processor 126 of the alerter device 125 may analyze or process the ITCM beacon message, for one or more locomotives, as follows:

Calculating distance between locomotive and alerter device 125 using alerter device 125 GPS location received via antenna 132 and GPS location received via ITCM message from the locomotive.

Calculating locomotive speed from multiple ITCM beacon messages.

Comparing calculated speed with broadcasted speed from the locomotive for error detection.

Calculate time to alerter device 125 based on speed.

Alerting wearer (i.e., one or more personnel 120) X minutes before reaching their location.

Displaying closest N (N being a positive integer) number of locomotives, including Locomotive ID 133 and distance 134. N is a predetermined number for showing a limit of locomotives, e.g., 4, 5 or 6 locomotives. The display may show multiple locomotives that may be approaching and may also show the computed time of arrival of each locomotive based on information in the ITCM beacon message.

Onboard ESP System 140—Description a. Onboard Alerter Application 142—this onboard software application resides on the Locomotive Messaging System hardware 140. The application listens to the GPS location that is published by the onboard PTC processor, e.g., a train management computer (TMC) such as from Wabtec, others can be used. The newly provided Onboard Alerter Application 142 creates an ITCM Beacon message that is transmitted on a predetermined interval such as, e.g., every 17 seconds. The message includes a special handling code therein so that the 220 MHz. PTC Radio broadcasts the message on the PTC Common Channel. The message includes:
   i. Locomotive ID
   ii. Current Locomotive Location (GPS)
   iii. Locomotive Speed
   iv. Timestamp of message Handheld ESP Alerter 125 a. Software Defined Radio (SDR) 129—the handheld Software Defined Radio (SDR) 129 is typically a listen only radio that may be permanently tuned to the PTC Common Channel (e.g., 221.XXXX MHz, or any other authorized band, such as 217 or 218 MHz bands). The SDR radio 129 listens for any messages that are received, discards any non-Beacon messages, and sends Beacon messages to the mobile alerter application 127 for further processing.

b. Mobile Alerter Application (MAA) 127—the mobile alerter application performs the following functionality:
   i. Ingest all beacon messages, determining payload content and analyzing:
      1. Distance to locomotive 110 from mobile alerter device 125
      2. Calculated Speed of locomotive 110 from prior locations in prior received messages.
      3. Compare calculated to reported speed of locomotive for error detection.
      4. Calculate time to mobile device location based on speed.
      5. Drive alert to user (i.e., personnel 120) when X minutes from current location, perhaps escalating sound level until acknowledged.
      6. Display closest N locomotives, including Locomotive ID and Distance on built in display 128.

Figure 4:
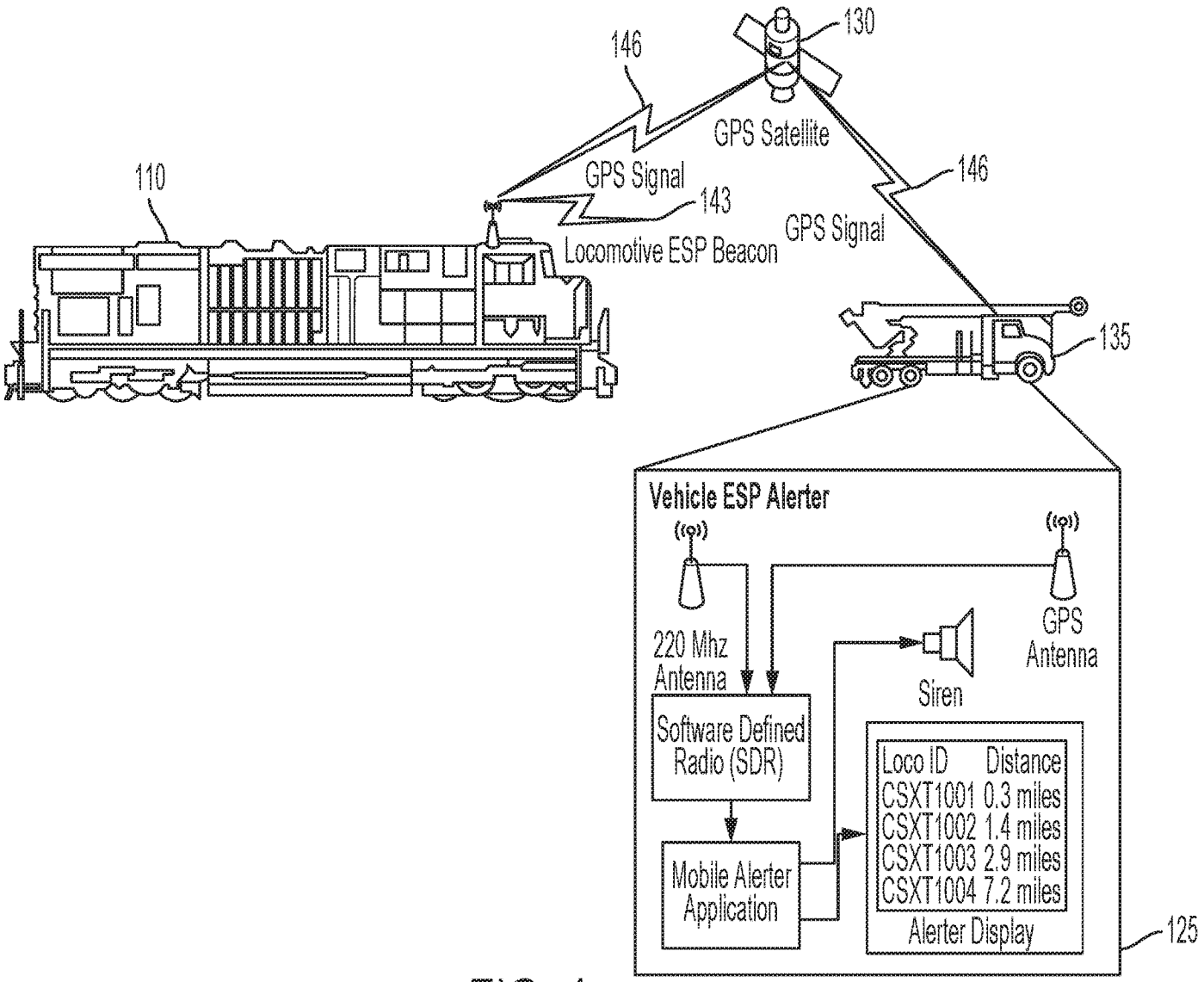
FIG. 4 is a generalized diagram of another example alerting system, according to the principles of the disclosure.
Figure 5:
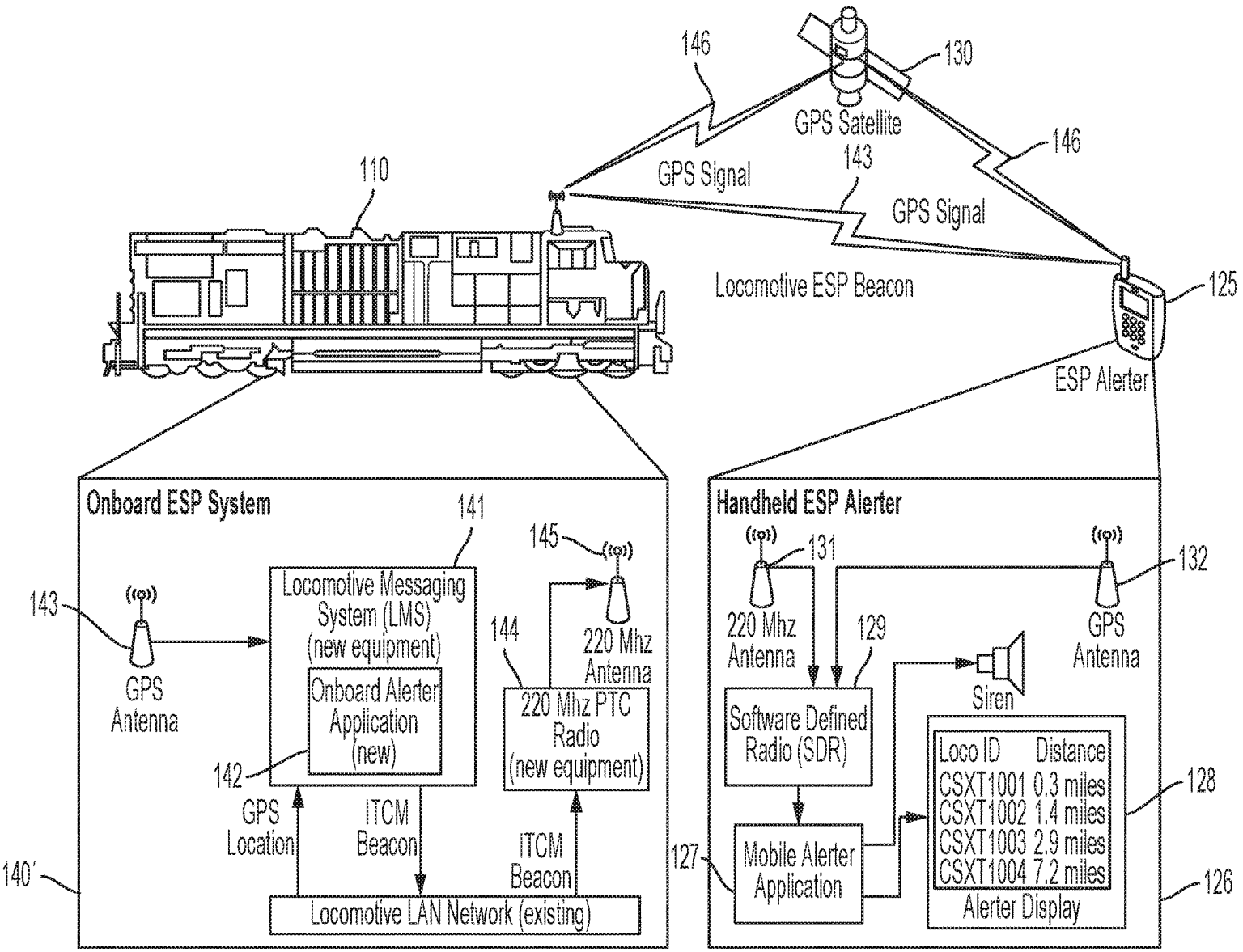
FIG. 5 is a generalized diagram of an example alerting system for non-PCT equipped locomotives, according to the principles of the disclosure.

FIG. 4 is an example illustration of a vehicle-based ESP alerter system, according to principles of the disclosure. In this example, a vehicle 135 may be equipped with an alerter 125 electronics and associated functionality and may be connected to the vehicle's battery for power. The alerter 125 may be repackaged to be mounted within the vehicle 135 and operated in the same manner as described above for alter device 125 functionality. The alerter 125 responds to FIG. 5 is a generalized diagram of an example alerting system for non-PCT equipped locomotives, according to the principles of the disclosure. This system is similar to the system shown in FIG. 3, except for non-PCT equipped locomotives that do not have a train management computer 139 as shown in FIG. 3, a low cost solution for providing ESP functionality requires only LMS messaging 141 platform, the OAP application 142, radio 144 and antennas 144 and 145. A train management computer, which is expensive, is not required. In this way, a non-PCT equipped locomotive can be retrofitted to provide ESP functionality, substantially improving safety to rail-side personnel even further.

Because these EPS systems described herein are intended to augment the safety of wayside workers, it may be important to ensure proper operation of the system. The following considerations and functionality is provided and facilitate that need:

Gaps in Communication—after receiving initial communication from a locomotive, if the handheld alerter device 125 does not receive subsequent messages in predetermined allotted time, the wearer is audibly notified and the display will show "???" (or, other special predetermined message) for distance.

Handheld functionality—fixed site, PTC base radios, e.g., 112, could be used to produce a test beacon signal to enable wearer to verify functionality of their handled device such as upon power-on. Alternatively, a test beacon might be integrated into the charger of the alerter device 125 for testing receive functionality. A manual test may be requested by a user to check for a test beacon, ensuring that the alerter device 125 is functioning.

Locomotives' IDs are not be displayed once three consecutive locomotive beacons are received showing the locomotive moving further way (passed the wayside location).

Multiple Locomotive Handling—the handheld alerter device 125 (or vehicle based device) is able to track a minimum of 10 locomotives, typically much more, in the area and maintain their information separately based on Locomotive ID contained in the beacon message. The alerter device 125 displays the closest N locomotives to the user, where N is an integer related to the maximum lines in a particular display, although scrolling of more than N locomotives is possible in embodiments. The alerter device 125 typically only creates an audible alert once for each train, once acknowledged by the wearer.

Audible Alert—the audible notification of a locomotive X minutes from a location may escalate in loudness until the user acknowledges the alert. A vibration alert may be provided to help users/wearers in loud environments.

Battery Life—the alerter device 125 displays its current battery charge at all times. It will notify wearer/user when battery life is below a predetermined level XX %. E.g., below 20%, 15% or 10%, but other levels may be used.

Locomotive Radio Logging—locomotive radios may log transmission of all beacons, per the locomotive radio logging protocols.

Event Logging—the alerter device 125 logs significant events to be utilized for failure and event analysis. These logs are maintained for a minimum period of time, such as e.g., 7 days in non-volatile memory and is retrievable via wired connection to the device. Logging includes, at a minimum:

a. Receipt of any locomotive location beacons
b. Changes to display content
c. Audible notifications and associated acknowledgment
d. Lost message notifications
e. Removal of locomotive once passed location
f. Battery low Alerts While the disclosure has been described in terms of exemplary embodiments, those skilled in the art will recognize that the disclosure can be practiced with modifications in the spirit and scope of the appended claims. These examples are merely illustrative and are not meant to be an exhaustive list of all possible designs, embodiments, applications, or modifications of the disclosure.

What is claimed is:

1. A alerting system for use with locomotives, comprising:

a messaging device positioned on at least one locomotive to initiate broadcast of a Positive Train Control (PTC) message including locomotive GPS location, locomotive speed and locomotive ID from the at least one locomotive to a surrounding geographic area of the at least one locomotive as the at least one locomotive is in motion; and an alerter device comprising a receiving radio that receives the PTC message at a wayside location and determines and displays on a display a distance that the at least one locomotive is to the wayside location, and provides an audible alert, wherein the alerter device removes the at least one locomotive ID from the alerter display after multiple consecutive locomotive beacons are received showing the locomotive moving further way.

2. The alerting system of claim 1, wherein the PTC message comprises an Interoperability Train Control Messaging (ITCM) that includes the locomotive GPS location, the locomotive speed and the locomotive ID, and timestamp of the ITCM message.

3. The alerting system of claim 2, wherein the Interoperability Train Control Messaging (ITCM) is sent at a predetermined interval on the PTC common channel so as to minimize message collisions on the common channel.

4. The alerting system of claim 1, wherein the alerter device receives the PTC message and performs one or more of the following:

a) calculates a distance to the at least one locomotive from the alerter device;
b) calculates a speed of the at least one locomotive from prior locations in prior received PTC messages;
c) compares the calculated speed to a reported speed of the at least one locomotive for error detection;
d) calculates a time to a location of the alerter device based on the speed of the at least one locomotive;
e) drives an alert to a user of the alerter device when the locomotive is at a predetermined amount of time from a current location of the locomotive to the location of the alerter device; and
f) displaying a plurality of locomotive IDs for a closest predetermined number of locomotives, including current locomotive distance for each of the pluriaty of locomotives on a display.

5. The alerting system of claim 1, wherein the alerter device is a receive-only device that does not transmit PTC signals.

6. The alerting system of claim 1, wherein the alerter device is a receive-only device and is pre-tuned to a fixed frequency.

7. The alerting system of claim 1, wherein the alerter device increases a level of the audible alert as the at least one locomotive approaches the alerter device.

8. The alerting system of claim 1, wherein the alerter device after receiving an initial ITCM communication from the at least one locomotive, initiates the audible alert after a predetermined amount of time passes without another ITCM message from the at least one locomotive.

9. The alerting system of claim 1, wherein the broadcast of the Positive Train Control (PTC) message is sent directly to the alerter device using a frequency in the 220 MHz band, or a frequency employed by PTC messaging.

10. A method for providing an alerting system for use with locomotives, comprising:

positioning a messaging device on at least one locomotive to initiate broadcast of a Positive Train Control (PTC) message including locomotive GPS location, locomotive speed and locomotive ID from the at least one locomotive to a surrounding geographic area of the at least one locomotive as the at least one locomotive is in motion; and receiving at an alerter device that comprises a receiving radio that receives the PTC message at a wayside rail location and determines and displays on a display a distance that the at least one locomotive is to the wayside rail location, and provides an audible alert, wherein the alerter device removes the at least one locomotive ID from the alerter display after multiple consecutive locomotive beacons are received showing the locomotive moving further way.

11. The method of claim 10, wherein the PTC message comprises an Interoperability Train Control Messaging (ITCM) that includes the locomotive GPS location, the locomotive speed and the locomotive ID, and timestamp of the ITCM message.

12. The method of claim 11, wherein the Interoperability Train Control Messaging (ITCM) is sent at a predetermined interval on the PTC common channel thereby minimize message collisions on the common channel.

13. The method of claim 10, wherein the alerter device receives the PTC message and performs one or more of the following:

a) calculates a distance to the at least one locomotive from the alerter device;
b) calculates a speed of the at least one locomotive from prior locations in prior received PTC messages;
c) compares the calculated speed to a reported speed of the at least one locomotive for error detection;
d) calculates a time to a location of the alerter device based on the speed of the at least one locomotive;
e) drives an alert to a user of the alerter device when the locomotive is at a predetermined amount of time from a current location of the locomotive to the location of the alerter device; and
f) displaying a plurality of locomotive IDs for a closest predetermined number of locomotives, including current locomotive distance for each of the pluriaty of locomotives on a display.

14. The method of claim 10, wherein the alerter device is a receive-only device that does not transmit PTC signals.

15. The method of claim 10, wherein the alerter device is a receive-only device and is pre-tuned to a fixed frequency.

16. The method of claim 10, further comprising increasing a level of the audible alert as the at least one locomotive approaches closer to the alerter device.

17. The method of claim 10, after receiving an initial ITCM communication from the at least one locomotive, initiating by the alerter device the audible alert after a predetermined amount of time passes without another ITCM message from the at least one locomotive.

18. The method of claim 10, wherein the broadcast of the Positive Train Control (PTC) message is sent directly to the alerter device using a frequency in the 220 MHz band, or other frequency employed by PTC messaging.

* * * * *